US009380865B2

(12) United States Patent
Tempas

(10) Patent No.: US 9,380,865 B2
(45) Date of Patent: Jul. 5, 2016

(54) ADJUSTABLE PNEUMATIC DESK

(71) Applicant: Robert Tempas, Hinsdale, IL (US)

(72) Inventor: Robert Tempas, Hinsdale, IL (US)

(73) Assignee: The Marvel Group, Inc., Chicago, IL (US)

( * ) Notice: Subject to any disclaimer, the term of this patent is extended or adjusted under 35 U.S.C. 154(b) by 0 days.

(21) Appl. No.: 14/506,803

(22) Filed: Oct. 6, 2014

(65) Prior Publication Data

US 2016/0095426 A1 Apr. 7, 2016

(51) Int. Cl.

| | |
|---|---|
| ***A47B 9/20*** | (2006.01) |
| ***A47B 21/02*** | (2006.01) |
| ***A47B 41/02*** | (2006.01) |
| ***A47B 9/14*** | (2006.01) |

(52) U.S. Cl.

CPC ... *A47B 9/20* (2013.01); *A47B 9/14* (2013.01); *A47B 21/02* (2013.01); *A47B 41/02* (2013.01)

(58) Field of Classification Search

CPC ..... A47B 9/00; A47B 9/02; A47B 9/04; A47B 9/06; A47B 9/08; A47B 9/10; A47B 9/12; A47B 9/14; A47B 9/20; A47B 17/02; A47B 21/02; A47B 41/02

USPC ..... 108/147.21

See application file for complete search history.

(56) References Cited

U.S. PATENT DOCUMENTS

| | | | | | |
|---|---|---|---|---|---|
| 3,701,506 | A * | 10/1972 | Favreau | 248/188.5 |
| 3,915,102 | A * | 10/1975 | Barron | 108/146 |
| 4,156,391 | A | 5/1979 | Ubezio | |
| 4,703,700 | A | 11/1987 | Sema | |
| 5,289,782 | A | 3/1994 | Rizzi et al. | |
| 5,601,036 | A * | 2/1997 | Kieser et al. | 108/107 |
| 6,038,986 | A * | 3/2000 | Ransil et al. | 108/145 |
| 6,070,840 | A * | 6/2000 | Kelley et al. | 248/188.4 |
| 6,546,880 | B2 | 4/2003 | Agee | |
| 6,854,402 | B2 * | 2/2005 | DuBarry et al. | 108/146 |
| 7,412,931 | B2 | 8/2008 | Seidl et al. | |
| 7,908,981 | B2 * | 3/2011 | Agee | 108/147 |
| 8,118,375 | B2 | 2/2012 | Berthiaume et al. | |
| 8,291,833 | B2 | 10/2012 | Skiba | |
| 8,342,465 | B2 * | 1/2013 | Koder | 248/188.5 |
| 8,671,853 | B2 | 3/2014 | Flaherty | |
| 2003/0089287 | A1 * | 5/2003 | Tseng | 108/147.21 |
| 2004/0060486 | A1 * | 4/2004 | Franze et al. | 108/147.19 |
| 2006/0130713 | A1 * | 6/2006 | Jones | A47B 9/00 108/106 |
| 2007/0215765 | A1 * | 9/2007 | Nagel et al. | 248/161 |
| 2008/0084147 | A1 * | 4/2008 | Brown | 312/223.3 |
| 2008/0087788 | A1 * | 4/2008 | Cheng et al. | 248/404 |
| 2013/0152833 | A1 | 6/2013 | Pfaff | |
| 2014/0158026 | A1 | 6/2014 | Flaherty | |
| 2015/0047538 | A1 * | 2/2015 | Ergun et al. | 108/147 |

* cited by examiner

*Primary Examiner* — Daniel Rohrhoff

(74) *Attorney, Agent, or Firm* — Law Offices of Eugene M. Cummings, P.C.

(57) ABSTRACT

An adjustable pneumatic desk having telescoping upper and lower bases for positioning a worksurface relative the floor. A spring biased locking mechanism sets the height of the desk via prong engagement of incrementally height adjustably spaced engagement slots.

3 Claims, 7 Drawing Sheets

ADJUSTABLE PNEUMATIC DESK

CROSS-REFERENCE TO RELATED APPLICATION

None.

BACKGROUND OF THE INVENTION

I. Field of the Invention

The present disclosure relates generally to desks, and more specifically to a student desk having a pneumatically adjustable height and an improved locking mechanism.

II. Description of the Prior Art

Traditionally institutional as well as office and/or industrial environments stand-alone desks and workstations have been configured for limited end-use situations. For example, school desks are typically configured for use by seated students and have no height adjustment. Such desks generally limit the scope or use of such desks to a small range of age groups, requiring schools and institutions using such desks to carry large inventories of desks of differing sizes to accommodate varying sizes of students of different age groups.

Recent studies have suggested that student learning may be improved as a result of greater comfort and attention if the desk is configured such that the student can stand while using the desk. Stand-up learning might be particularly beneficial for students with excess energy or short attention spans, such as may be the case for those suffering from Attention Deficit Disorder or Attention Deficit Hyperactivity Disorder. Additionally, it has been well documented that sitting for long periods of time, especially older people in office and/or industrial environments, is generally not good for one's health. Medical studies show that sitting increases the rate of all-cause mortality, especially from cardiovascular disease, diabetes and obesity, for example. Therefore there exists a need to create an institutional and work environment that is ergonomic for someone standing as well as sitting, and allows the transition to be easy, quick, and simple.

Height adjustable tables enable different users to comfortably use the table notwithstanding differences in height. Additionally, height adjustable tables enable a user to vary the elevation of the table depending upon the activity being conducted.

It is well known in the art to provide a desk with a height adjustment feature for enabling the height of the worksurface to be adjusted relative to a supporting surface such as a floor. While there exists a plethora of means and methods by which to provide such adjustments, including pneumatic, crank and electric, they generally comprise complex components that are relatively expensive to produce. Therefore, there exists a need for a new and improved desk that includes an inexpensive and easily used adjustment and lock mechanism.

Accordingly, it is a general object of this disclosure to provide a cost effective and easy to use desk height adjustment and locking mechanism.

It is a more specific object of the present disclosure to provide a pneumatically height adjustable desk with a locking mechanism.

These and other objects, features and advantages of this disclosure will be clearly understood through a consideration of the following detailed description.

SUMMARY OF THE INVENTION

According to an embodiment of the present disclosure, there is provided a height adjustable desk having an upper base and a lower base telescopingly receiving one another thereby adjusting the height of the desk worksurface relative to the floor support. A locking mechanism engages incremental spaced engagement slots to lock the desk at the desired height.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

One or more embodiments of the subject disclosure will now be described with the aid of numerous drawings. Unless otherwise indicated, use of the term "desk" will be understood to include student desks, standing desks, draftsman desks, work benches, office desks, as well as other devices for supporting the work of a student, employee or the like.

Figure 1:
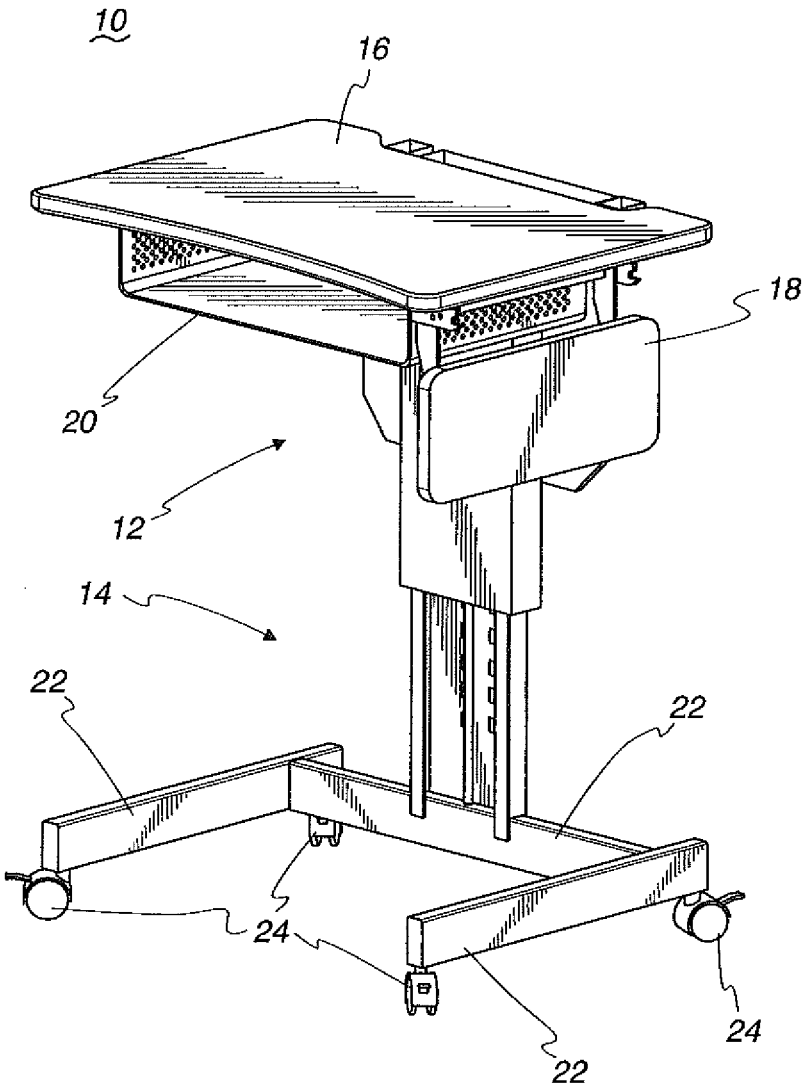
FIG. 1 a frontal perspective view of an adjustable pneumatic desk according to the principles of an embodiment of the present disclosure.
Figure 2A:
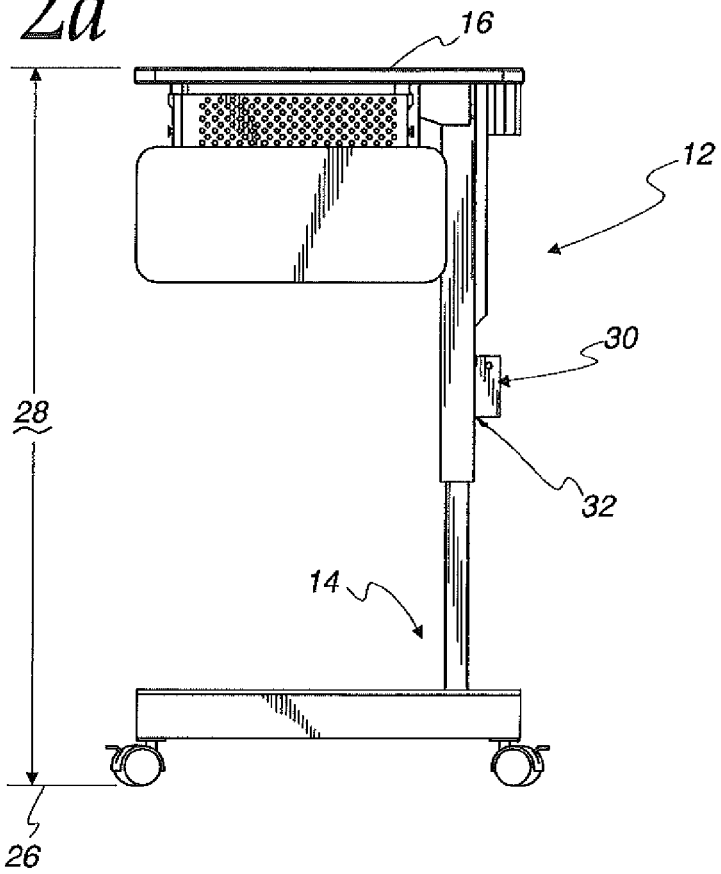
FIG. 2*a* is a right side view of the desk on FIG. 1 in a full up position.
Figure 2B:
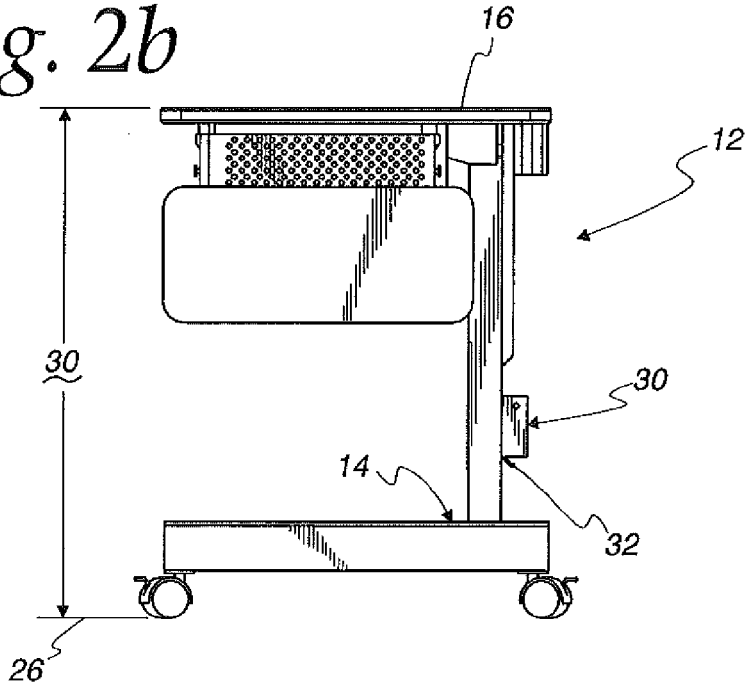
FIG. 2*b* is a right side view of the desk of FIG. 1 in a full down position.

In any event, turning now to the Figures, and in particular FIG. 1, the desk 10 includes an upper base 12 and a lower base 14. The upper base 12 primarily consisting of a main worksurface 16, a flip-up shelf 18 and storage 20. The lower base 14 primarily consisting of a frame having a plurality of floor supports 22 which may further include wheels/casters 24 with or without brakes. Turning now to FIGS. 2*a* and 2*b*, the upper base 12 telescopingly receives the lower base 14 and the height of the worksurface 16 relative to the floor 26 is thereby adjustable from a maximum height 28 of FIG. 2*a* to a minimum height 30 of FIG. 2*b*. The ability to release the telescoping members of the upper 12 and lower 14 bases is performed by opening the locking mechanism 30 with the handle 32. Similarly, once the height of the worksurface 16 is positioned, the handle 32 is placed in the locked position.

Figure 3:
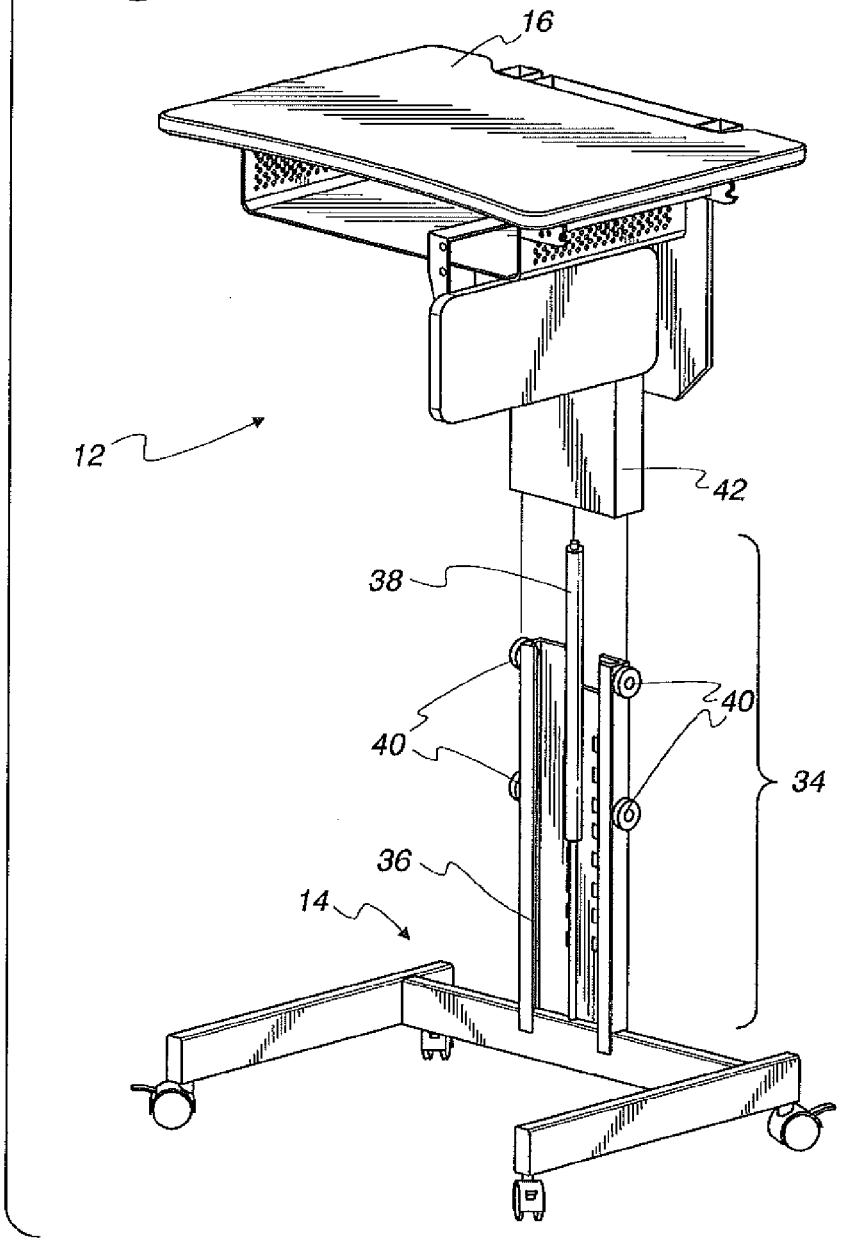
FIG. 3 is a semi-exploded perspective view of the desk of FIG. 1 showing the adjustable pneumatics thereof.

FIG. 3 is a semi-exploded perspective view of the desk 10 showing the adjustable pneumatics of the upper 12 and lower 14 bases. The telescoping portion 34 of the lower base 14 includes a vertical column member 36, a pneumatic gas spring assembly 38 and bearing wheels 40. The telescoping portion of the upper base 12 includes a sleeve member 42 for receiving the lower base telescoping portion. When engaged, the pneumatic gas spring assembly 38 is coupled to the sleeve member and provides the upward force to easily raise the height of the worksurface 16, while the preferably nylon bearing wheels 40 provide a smooth transition of the adjustable heights.

Figure 4:
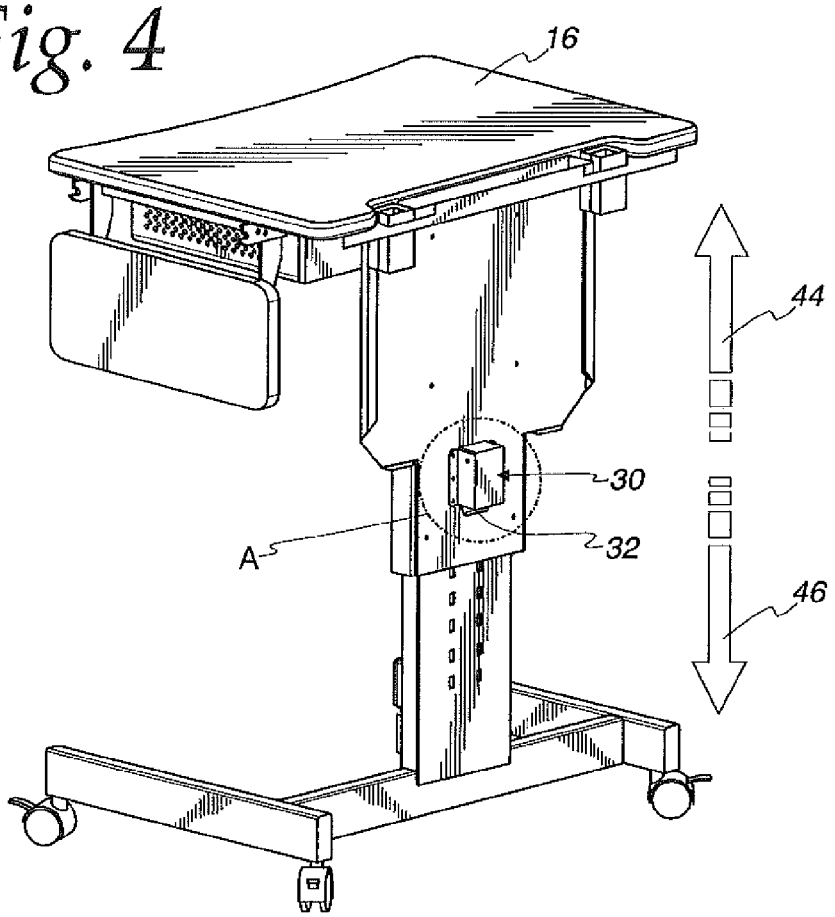
FIG. 4 is a rear perspective view of the desk of FIG. 1.
Figure 5:
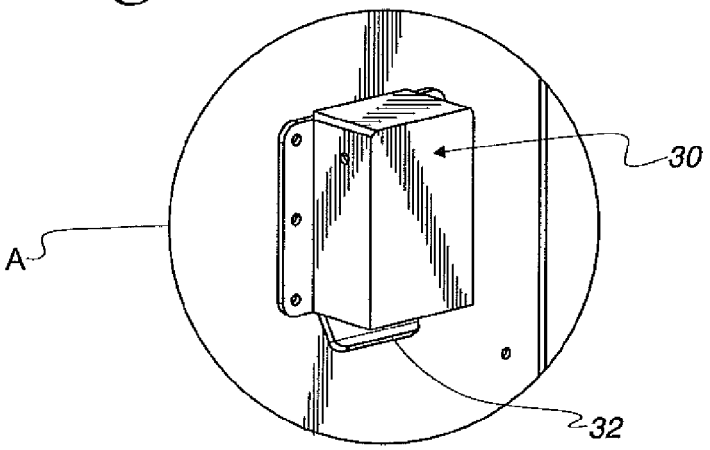
FIG. 5 is an enlarged view of the encompassed A of FIG. 4.

The rear views of FIGS. 4 and 5 illustrate the use of the locking mechanism 30 when adjusting the height of the worksurface 16 of the desk 10. In particular, via a single hand operation, the user engages the handle 32 (thereby unlocking the telescoping portions) and then, with the aide of the pneumatic spring, can gently and easily raise 44 or lower 46 the height of the worksurface 16 to a new position. The gas spring is basically used as a counterbalance for the desk. Once at the desired height, the user then releases the handle 32 and locks the members together.

Figure 6:
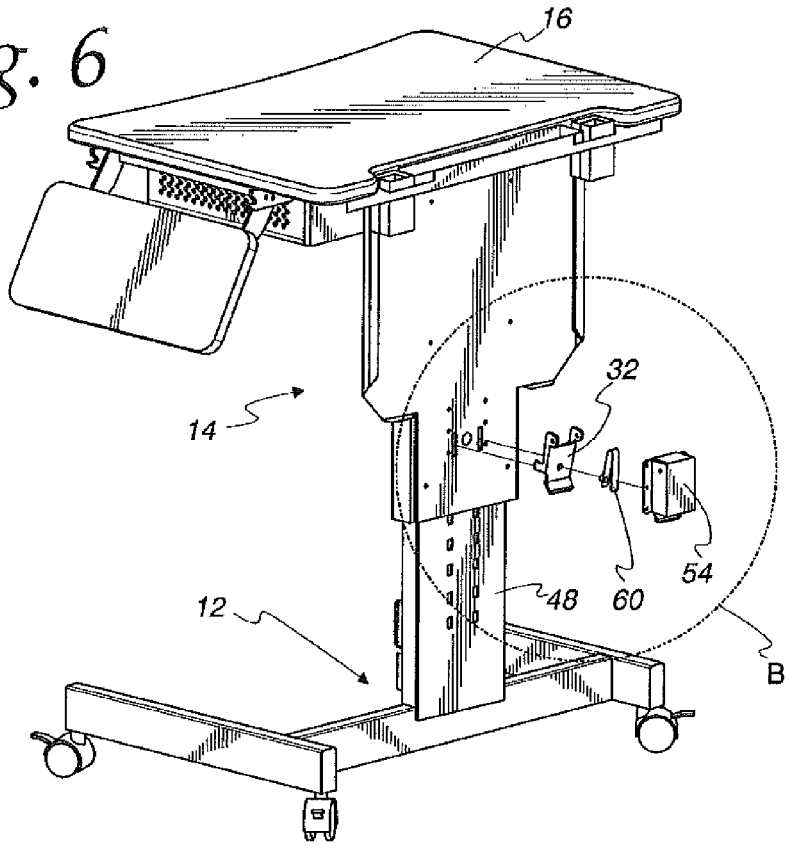
FIG. 6 is a partially exploded view of the desk of FIG. 4.
Figure 7:
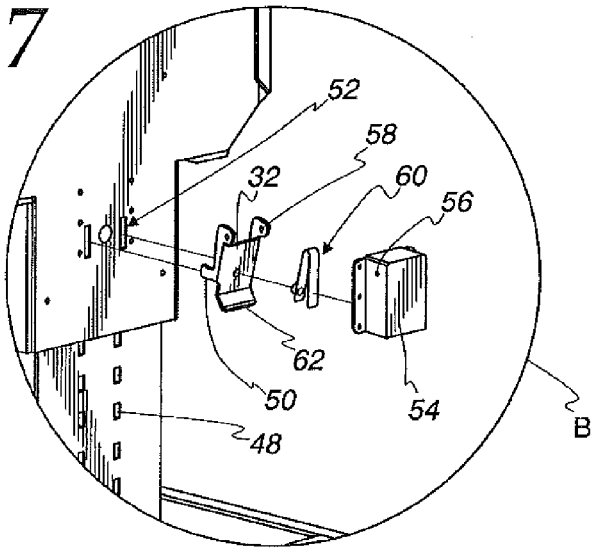
FIG. 7 is an enlarged exploded view of the encompassed B of FIG. 6.

Turning now to the exploded views of FIGS. 6 and 7, the inner workings of the locking mechanics of the present disclosure will be more particular described. As shown, the telescoping portion of the lower base 12 includes a plurality of spaced engagement slots 48 arranged at incremental heights from near the bottom to near the top of the telescoping portion; and the handle 32 includes prongs 50 that engage the engagement slots 48 through the clearance slots 52 of the upper base 12 sleeve member 42. The handle 32 is held in place by the cover 54 using rivets (not shown) as hinges through both the cover hinge holes 56 in the cover 54 and the handle hinge holes 58 in the handle 32. The handle is biased and held in the closed position, whereby the handle prongs 50 are engaged with the engagement slots 48, by a spring 60. This is what holds the desk in place at the desired height of the workstation 16 and prevents it from going up or down during use. To adjust the height, the handle lip is pulled back to disengage the handle prongs 50 from the engagement slots 48 and desk 10 height can be adjusted up or down. Releasing the handle lip 62 re-engages the prongs and the desk 10 can be used at the new height.

Figure 8:
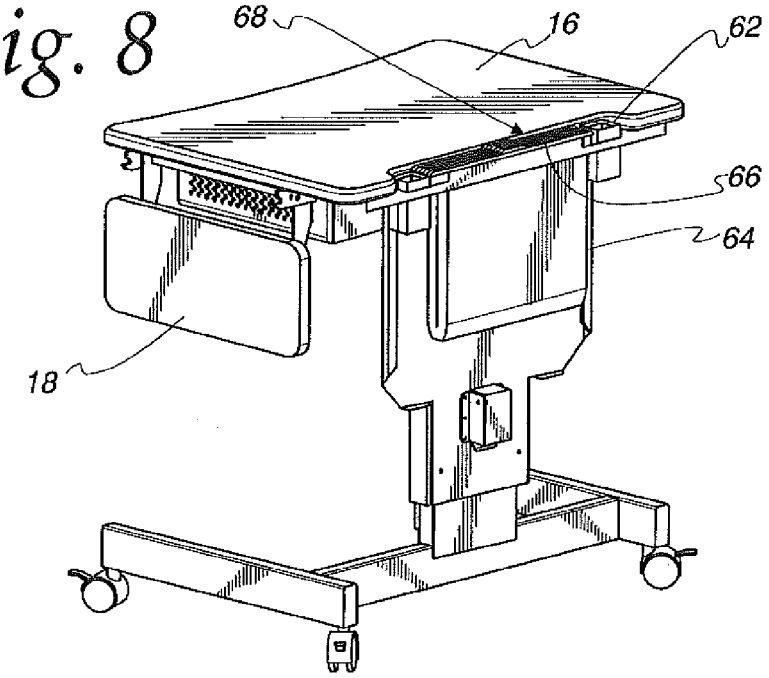
FIG. 8 is an enlarged rear perspective view of the desk of FIG. 1.
Figure 9:
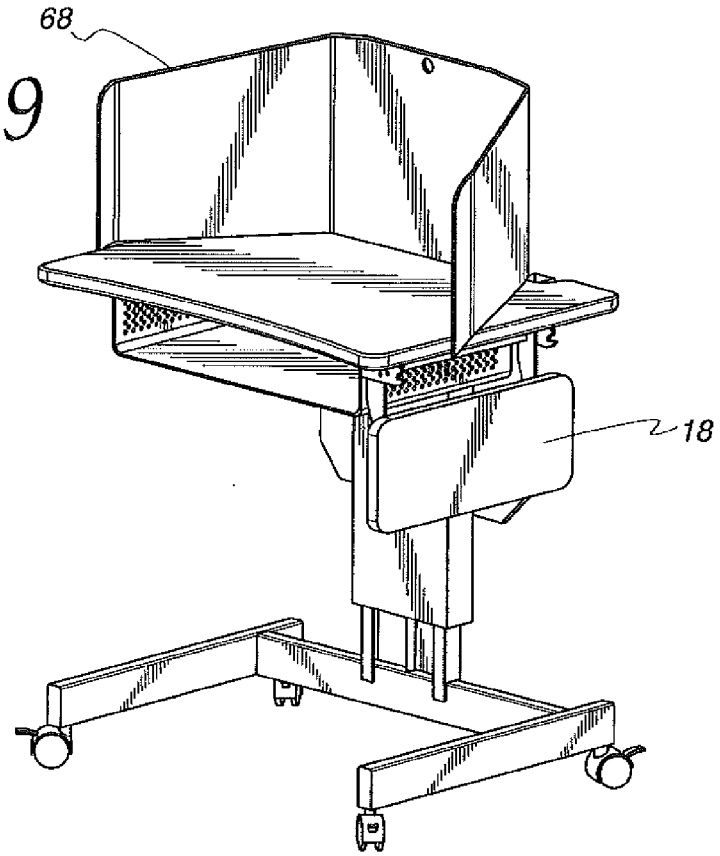
FIG. 9 is an enlarged frontal perspective view of the desk of FIG. 1.
Figure 10:
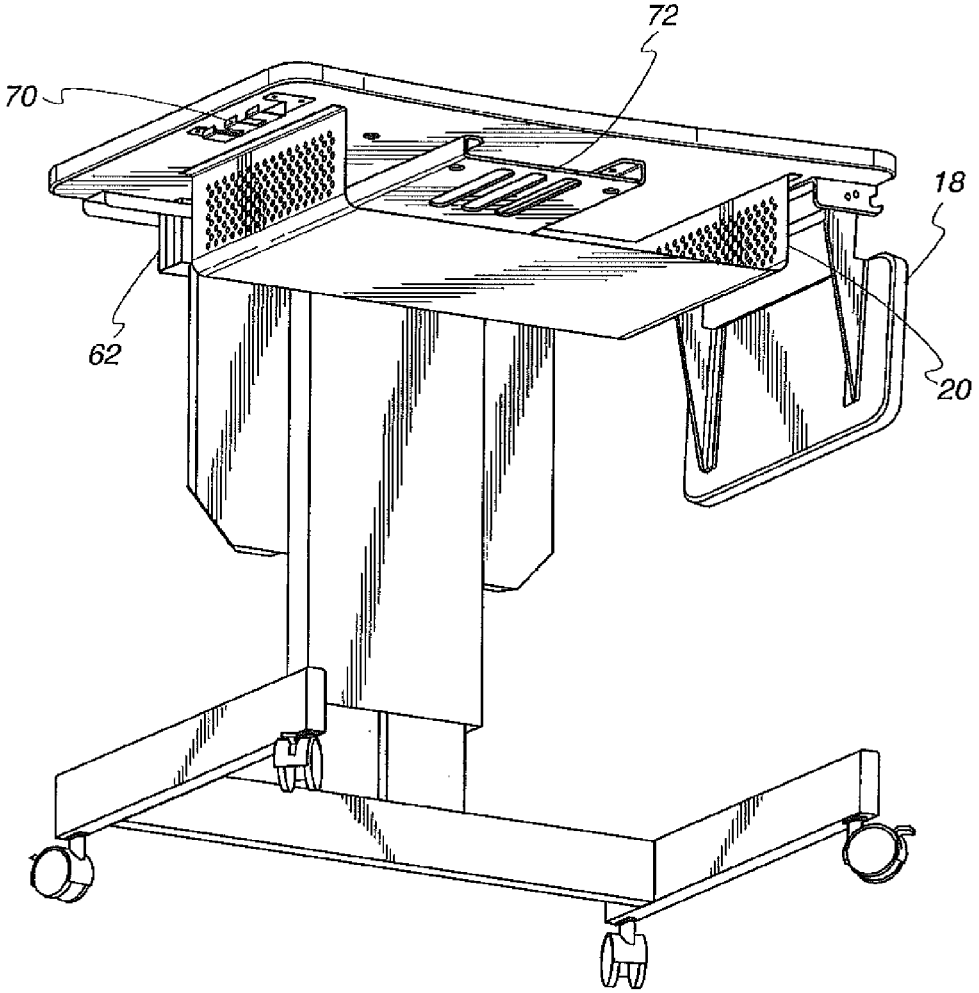
FIG. 10 is an enlarged bottom frontal view of the desk of FIG. 1.

The student desk embodiment of the present disclosure will now be shown and described through the illustrations of FIG. 8-9. Additional features of the student desk include integrated pencil cups for holding pens, pencils, etc. to keep the desk top worksurface 16 cleaner. A file folder frame 64 is integrated into the desk, allowing personalized access to homework, assignments, and/or handouts, etc. for both teacher and student. A teacher can return homework, hand out assignments, etc. by placing papers in one of several hanging file folders 66. A retractable corrugated privacy screen is integrated into the desk. This allows the student or teacher instant access to privacy and/or to shut out distractions, without having to get up and walk across the room to find a corrugated screen. Easy to use, simply remove from its retracted position (FIG. 8) and open up to its use position (FIG. 9); and easy to replace when worn out, damaged or "decorated" by the student. 96. Remaining features of the student desk are shown in FIG. 10 and may include utility hooks 70 for backpacks and the like; and a laptop/tablet storage bin 72.

It will be appreciated that while the disclosed embodiment has been particular described with respect to a student desk, any type of desk or worksurface may be used with the present disclosure height adjustment and locking mechanism.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A height adjustable desk comprising:

an upper base having a worksurface;

a lower base having a floor support;

a first portion of one of said bases telescopingly receiving a second portion of the other of said bases thereby adjusting the height of said worksurface relative to said floor support;

said second portion includes a pneumatic spring assembly coupled to said first portion, and further includes a plurality of wheels for bearing against said first portion during height transition;

a plurality of spaced engagement slots arranged at incremental heights on one of said portions; and a locking mechanism on one of said portions includes a covered handle biased in a closed position and having one or more prongs for engaging said slots and locking said portions thereby setting a height of said worksurface relative to said floor support.

2. The height adjustable desk as defined in claim 1 wherein said lower base includes wheels.

3. The height adjustable desk as defined in claim 1 wherein said locking mechanism includes releasable prongs biased in an engaging position with said slots.

* * * * *